US008175881B2

(12) United States Patent
Morinaka et al.

(10) Patent No.: US 8,175,881 B2
(45) Date of Patent: May 8, 2012

(54) METHOD AND APPARATUS USING FUSED FORMANT PARAMETERS TO GENERATE SYNTHESIZED SPEECH

(75) Inventors: Ryo Morinaka, Tokyo (JP); Masatsune Tamura, Tokyo (JP); Takehiko Kagoshima, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 869 days.

(21) Appl. No.: 12/222,725

(22) Filed: Aug. 14, 2008

(65) Prior Publication Data

US 2009/0048844 A1 Feb. 19, 2009

(30) Foreign Application Priority Data

Aug. 17, 2007 (JP) ..... 2007-212809

(51) Int. Cl.
*G10L 13/06* (2006.01)

(52) U.S. Cl. ..... 704/261

(58) Field of Classification Search ..... 704/258–269
See application file for complete search history.

(56) References Cited

U.S. PATENT DOCUMENTS

| | | | | |
|---|---|---|---|---|
| 3,828,132 | A * | 8/1974 | Flanagan et al. | 704/268 |
| 4,979,216 | A * | 12/1990 | Malsheen et al. | 704/260 |
| 6,615,174 | B1 * | 9/2003 | Arslan et al. | 704/270 |
| 7,251,607 | B1 | 7/2007 | Kagoshima et al. | |
| 2002/0138253 | A1 | 9/2002 | Kagoshima et al. | |
| 2003/0212555 | A1 * | 11/2003 | van Santen | 704/241 |
| 2004/0073427 | A1 * | 4/2004 | Moore | 704/258 |
| 2005/0137870 | A1 * | 6/2005 | Mizutani et al. | 704/264 |
| 2008/0195391 | A1 * | 8/2008 | Marple et al. | 704/260 |

FOREIGN PATENT DOCUMENTS

| | | |
|---|---|---|
| JP | 2002-358090 | 12/2002 |
| JP | 2005-164749 | 6/2005 |

* cited by examiner

*Primary Examiner* — Abul Azad

(74) *Attorney, Agent, or Firm* — Nixon & Vanderhye, P.C.

(57) ABSTRACT

A phoneme sequence corresponding to a target speech is divided into a plurality of segments. A plurality of speech units for each segment is selected from a speech unit memory that stores speech units having at least one frame. The plurality of speech units has a prosodic feature accordant or similar to the target speech. A formant parameter having at least one formant frequency is generated for each frame of the plurality of speech units. A fused formant parameter of each frame is generated from formant parameters of each frame of the plurality of speech units. A fused speech unit of each segment is generated from the fused formant parameter of each frame. A synthesized speech is generated by concatenating the fused speech unit of each segment.

16 Claims, 16 Drawing Sheets

| SPEECH UNIT NUMBER | SPEECH UNIT WAVEFORM |
|---|---|
| 0 | |
| 1 | |
| 2 | |
| ⋮ | ⋮ |

| SPEECH UNIT NUMBER | PHONEME SYMBOL (NAME) | FUNDAMENTAL FREQUENCY(Hz) | PHONEME DURATION (msec) | CONCATENATION BOUNDARY CEPSTRUM |
|---|---|---|---|---|
| 0 | /a/ | 308.6 | 74.0 | |
| 1 | /a/ | 300.5 | 65.4 | $c_0(1), c_0(T)$ |
| 2 | /i/ | 334.6 | 69.5 | $c_1(1), c_1(T)$ |
| : | : | : | : | $c_2(1), c_2(T)$ |
FIG. 5
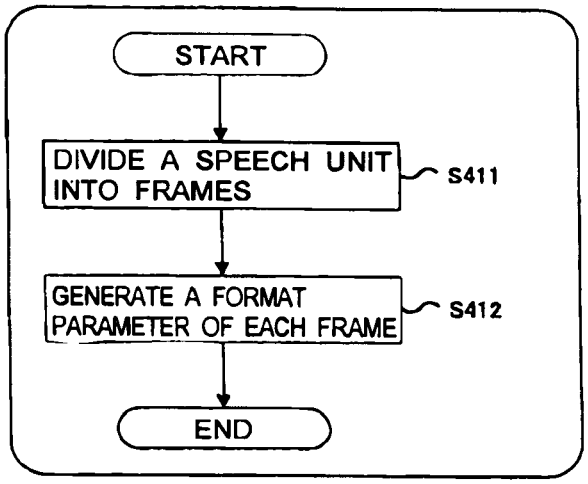
FIG. 6
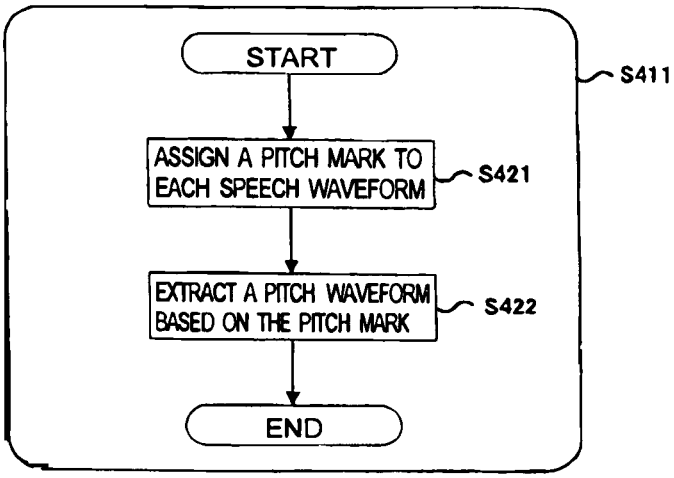
FIG. 7

| SPEECH UNIT NUMBER | FRAME NUMBER | FORMANT NUMBER | FORMANT FREQUENCY | POWER | PHASE | WINDOW FUNCTION |
|---|---|---|---|---|---|---|
| 0 | 0 | 1 | 0.11 | 4000 | 0.01 | |
| | | 2 | 0.23 | 3000 | -0.20 | |
| | | 3 | 0.35 | 2000 | 0.15 | |
| | 1 | 1 | 0.10 | 4100 | 0.02 | |
| | | 2 | 0.24 | 3100 | -0.15 | |
| | | 3 | 0.36 | 2100 | 0.20 | |
| | 2 | 1 | 0.09 | 4050 | 0.04 | |
| | | 2 | 0.25 | 3050 | -0.12 | |
| | | 3 | 0.38 | 2050 | 0.23 | |

FIG. 10

| FRAME NUMBER | FORMANT NUMBER | FORMANT FREQUENCY | POWER | PHASE | WINDOW FUNCTION |
|---|---|---|---|---|---|
| 0 | 1 | 0.11 | 4000 | 0.01 | |
| | 2 | 0.23 | 3000 | −0.20 | |
| | 3 | 0.35 | 2000 | 0.15 | |

485

| FRAME NUMBER | FORMANT NUMBER | FORMANT FREQUENCY | POWER | PHASE | WINDOW FUNCTION |
|---|---|---|---|---|---|
| 0 | 1 | 0.10 | 4100 | 0.02 | |
| | 2 | 0.22 | 3100 | −0.15 | |
| | 3 | 0.24 | 3050 | −0.13 | |
| | 4 | 0.34 | 2100 | 0.20 | |

486

S481
S482

| FRAME NUMBER | FORMANT NUMBER | FORMANT FREQUENCY | POWER | PHASE | WINDOW FUNCTION |
|---|---|---|---|---|---|
| 0 | 1 | 0.11 | 4000 | 0.01 | |
| | 2 | 0.23 | 3000 | −0.20 | |
| | 3 | 0.35 | 2000 | 0.15 | |

485

| FRAME NUMBER | FORMANT NUMBER | FORMANT FREQUENCY | POWER | PHASE | WINDOW FUNCTION |
|---|---|---|---|---|---|
| 0 | 1 | 0.10 | 4100 | 0.02 | |
| | 2 | 0.22 | 3100 | −0.15 | |
| | 3 | 0.24 | 3050 | −0.13 | |
| | 4 | 0.34 | 2100 | 0.20 | |

486

S483

| FRAME NUMBER | FORMANT NUMBER | FORMANT FREQUENCY | POWER | PHASE | WINDOW FUNCTION |
|---|---|---|---|---|---|
| 0 | 1 | 0.11 | 4000 | 0.01 | |
| | 2 | 0.23 | 3000 | −0.20 | |
| | | 0.24 | 0 | 0 | |
| | 4 | 0.35 | 2000 | 0.15 | |

485'

| FRAME NUMBER | FORMANT NUMBER | FORMANT FREQUENCY | POWER | PHASE | WINDOW FUNCTION |
|---|---|---|---|---|---|
| 0 | 1 | 0.10 | 4100 | 0.02 | |
| | 2 | 0.22 | 3100 | −0.15 | |
| | 3 | 0.24 | 3050 | −0.13 | |
| | 4 | 0.34 | 2100 | 0.20 | |

486

S484

| FRAME NUMBER | FORMANT NUMBER | FORMANT FREQUENCY | POWER | PHASE | WINDOW FUNCTION |
|---|---|---|---|---|---|
| 0 | 1 | 0.105 | 4050 | 0.015 | |
| | 2 | 0.225 | 3050 | −0.175 | |
| | 3 | 0.24 | 1525 | −0.065 | |
| | 4 | 0.345 | 2050 | 0.175 | |

487

FIG. 16

METHOD AND APPARATUS USING FUSED FORMANT PARAMETERS TO GENERATE SYNTHESIZED SPEECH

CROSS-REFERENCE TO RELATED APPLICATIONS

This application is based upon and claims the benefit of priority from prior Japanese Patent Application No. 2007-212809, filed on Aug. 17, 2007; the entire contents of which are incorporated herein by reference.

FIELD OF THE INVENTION

The present invention relates to a speech synthesis method and apparatus for generating a synthesized speech signal using information such as phoneme sequence, pitch, and phoneme duration.

BACKGROUND OF THE INVENTION

Artificial generation of a speech signal from an arbitrary sentence is called "text speech synthesis". In general, the text speech synthesis includes three steps of: language processing, prosody processing, and speech synthesis.

First, a language processing section morphologically and semantically analyzes an input text. Next, a prosody processing section processes accent and intonation of the text based on the analysis result, and outputs a phoneme sequence/prosodic information (fundamental frequency, phoneme segmental duration, power). Third, a speech synthesis section synthesizes a speech signal based on the phoneme sequence/prosodic information. In this way, text speech synthesis can be realized.

A principle of a synthesizer to synthesize arbitrary phoneme symbol sequence is explained. Assume that a vowel is represented as "V" and a consonant is represented as "C". Feature parameters (speech units) of a base unit such as CV, CVC and VCV are previously stored. By concatenating the speech units with control of pitch and duration, speech is synthesized. In this method, quality of the synthesized speech largely depends on the stored speech units.

As one of such speech synthesis method, a plurality of speech units is selected for each synthesis unit (each segment) by targeting an input phoneme sequence/prosodic information. A new speech unit is generated by fusing the plurality of speech units, and speech is synthesized by concatenating new speech units. Hereinafter, this method is called a plural unit selection and fusion method. For example, this method is disclosed in JP-A No. 2005-164749 (Kokai).

In the plural unit selection and fusion method, first, speech units are selected based on the input phoneme sequence/prosodic information (target) from a large number of speech units previously stored. As the unit selection method, a distortion degree between a synthesized speech and the target is defined as a cost function, and the speech units are selected so that a value of the cost function minimizes. For example, a target distortion representing a difference of prosody/phoneme environment between a target speech and each speech unit, and a concatenation distortion occurred by concatenating speech units, are numerically evaluated as a cost. Speech units used for speech synthesis are selected based on the cost, and fused using a particular method, i.e., pitch waveforms of the speech units are averaged, or centroids of the speech segments are used. As a result, synthesized speech is stably obtained while suppressing fall of quality in editing/concatenating speech units.

Furthermore, as a method for generating speech units having high quality, the speech units stored are represented using formant frequency. For example, this method is disclosed in Japanese Patent No. 3732793. In this method, a waveform of formant (Hereafter, it is called "formant waveform") is represented by multiplying a window function with a sinusoidal wave having a formant frequency. A speech waveform is represented by adding each formant waveform.

However, in speech synthesis of the plural unit selection and fusion method, waveforms of the speech units are directly fused. Accordingly, a spectral of a synthesized speech becomes unclear and quality of the synthesized speech falls. This problem is caused by fusing speech units having different formant frequencies. As a result, a formant of fused speech units is unclear and the quality falls.

SUMMARY OF THE INVENTION

The present invention is directed to a speech synthesis method and apparatus for generating synthesized speech with high quality for plural unit selection and fusion method.

According to an aspect of the present invention, there is provided a method for synthesizing a speech, comprising: dividing a phoneme sequence corresponding to a target speech into a plurality of segments; selecting a plurality of speech units for each segment from a speech unit memory storing speech units having at least one frame, the plurality of speech units having a prosodic feature accordant or similar to the target speech; generating a formant parameter having at least one formant frequency for each frame of the plurality of speech units; generating a fused formant parameter of each frame from formant parameters of each frame of the plurality of speech units; generating a fused speech unit of each segment from the fused formant parameter of each frame; and generating a synthesized speech by concatenating the fused speech unit of each segment.

According to another aspect of the present invention, there is also provided an apparatus for synthesizing a speech, comprising: a division section configured to divide a phoneme sequence corresponding to a target speech into a plurality of segments; a speech unit memory that stores speech units having at least one frame; a speech unit selection section configured to select a plurality of speech units for each segment from the speech unit memory, the plurality of speech units having a prosodic feature accordant or similar to the target speech; a formant parameter generation section configured to generate a formant parameter having at least one formant frequency for each frame of the plurality of speech units; a fused formant parameter generation section configured to generate a fused formant parameter of each frame from formant parameters of each frame of the plurality of speech units; a fused speech unit generation section configured to generate a fused speech unit of each segment from the fused formant parameter of each frame; and a synthesis section configured to generate a synthesized speech by concatenating the fused speech unit of each segment.

According to still another aspect of the present invention, there is also provided a computer readable medium storing program codes for causing a computer to synthesizing a speech, the program codes comprising: a first program code to divide a phoneme sequence corresponding to a target speech into a plurality of segments; a second program code to select a plurality of speech units for each segment from a speech unit memory storing speech units having at least one frame, the plurality of speech units having a prosodic feature accordant or similar to the target speech; a third program code to generate a formant parameter having at least one formant frequency for each frame of the plurality of speech units; a fourth program code to generate a fused formant parameter of each frame from formant parameters of each frame of the plurality of speech units; a fifth program code to generating a fused speech unit of each segment from the fused formant parameter of each frame; and a sixth program code to generate a synthesized speech by concatenating the fused speech unit of each segment.

BRIEF DESCRIPTION OF THE DRAWINGS

FIG. 5 is an example of a speech environment stored in a phoneme environment memory.

FIG. 6 is a flow chart of processing of a formant parameter generation section.

FIG. 7 is a flow chart of processing to generate pitch waveforms from speech units.

FIG. 10 is an example of formant parameters stored in a formant parameter memory.

FIG. 16 is a schematic diagram to explain fusion processing of formant parameters.

DETAILED DESCRIPTION OF THE EMBODIMENTS

Figure 1:
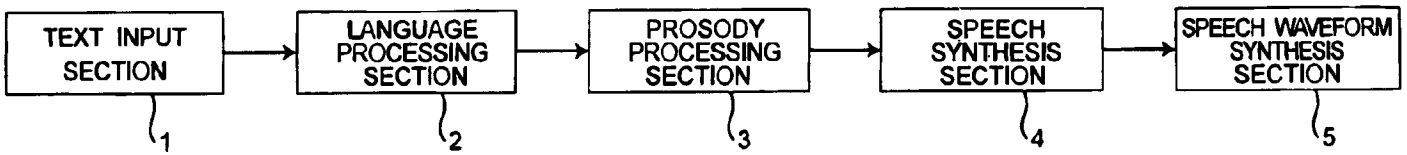
FIG. 1 is a block diagram of a speech synthesis apparatus according to a first embodiment.

Hereinafter, various embodiments of the present invention will be explained by referring to the drawings. The present invention is not limited to the following embodiments.

(First Embodiment)

A text speech synthesis apparatus of the first embodiment is explained by referring to FIGS. 1~19.

(1) Component of the Text Speech Synthesis Apparatus

FIG. 1 is a block diagram of the text speech synthesis apparatus of the first embodiment. The text speech synthesis apparatus includes a text input section 1, a language processing section 2, a prosody processing section 3, a speech synthesis section 4, and a speech waveform output section 5.

The language processing section 2 morphologically and syntactically analyzes a text input from the text input section 1, and outputs the analysis result to the prosody processing section 3. The prosody processing section 3 processes accent and intonation from the analysis result, generates a phoneme sequence and prosodic information, and outputs them to the speech synthesis section 4. The speech synthesis section 4 generates a speech waveform from the phoneme sequence and prosodic information, and outputs via the speech waveform output section 5.

Figure 2:
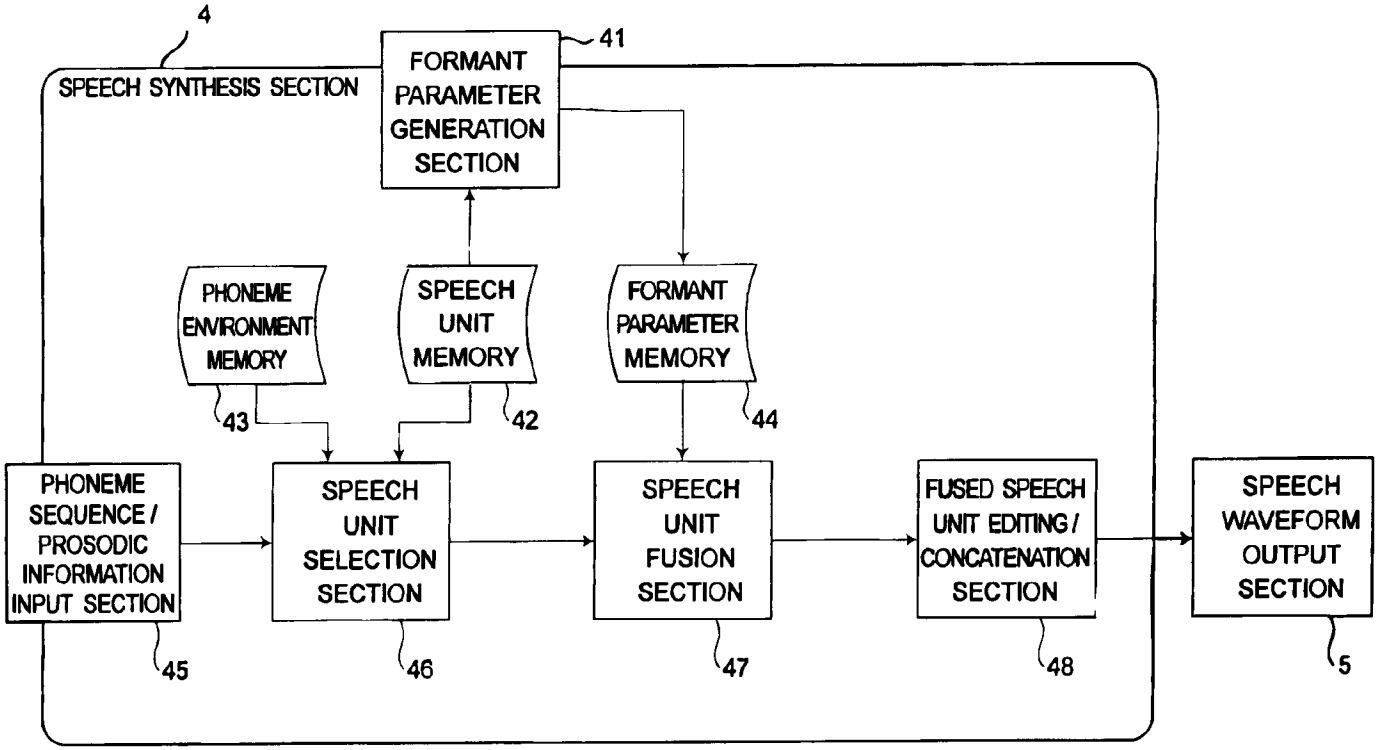
FIG. 2 is a block diagram of a speech synthesis section in FIG. 1.

(2) Component of the Speech Synthesis Section 4:

FIG. 2 is a block diagram of the speech synthesis section 4 in FIG. 1. As shown in FIG. 2, the speech synthesis section 4 includes a formant parameter generation section 41, a speech unit memory 42, a phoneme environment memory 43, a formant parameter memory 44, a phoneme sequence/prosodic information input section 45, a speech unit selection section 46, a speech unit fusion section 47, and a fused speech unit editing/concatenation section 48.

(2-1) The Speech Unit Memory 42:

The speech unit memory 42 stores a large number of speech units as a synthesis unit to generate synthesized speech. The synthesis unit is a combination of a phoneme or a divided phoneme, for example, a half-phoneme, a phone (C,V), a diphone (CV,VC,VV), a triphone (CVC,VCV), a syllable (CV,V) (V: vowel, C: consonant). These may be variable length as mixture.

(2-2) The Phoneme Environment Memory 43:

The speech unit environment memory 43 stores phoneme environment information of each speech unit stored in the speech unit memory 42. The phoneme environment is combination of environmental factor of each speech unit. The factor is, for example, a phoneme name, a previous phoneme, a following phoneme, a second following phoneme, a fundamental frequency, a phoneme duration, a power, a stress, a position from accent core, a time from breath point, an utterance speed, and a feeling.

(2-3) The Formant Parameter Memory 44:

The formant parameter memory 44 stores a formant parameter generated by formant parameter generation section 41. The "formant parameter" includes a formant frequency and a parameter representing a shape of each formant.

(2-4) The Phoneme Sequence/Prosodic Information Input Section 45:

The phoneme sequence/prosodic information input section 45 inputs the phoneme sequence/prosodic information (output from the prosody processing section 3). The prosodic information is a fundamental frequency, a phoneme duration, and a power. Hereinafter, the phoneme sequence/prosodic information input to the phoneme sequence/prosodic information input section 45 are respectively called input phoneme sequence/input prosodic information. The input phoneme sequence is, for example, a sequence of phoneme symbols.

(2-5) The Speech Unit Selection Section 46:

As to each segment divided from the input phoneme sequence by a synthesis unit, the speech unit selection section 46 estimates a distortion degree between an input prosodic information and the prosodic information included in the speech environment of each speech unit, and selects a plurality of speech units from the speech unit memory 42 so that the distortion degree is minimized. As the distortion degree, a cost function (explained afterwards) can be used. However, the distortion degree is not limited to this. As a result, speech units corresponding to the input phoneme sequence are obtained.

(2-6) The Speech Unit Fusion Section 47:

As to a plurality of speech units for each segment (selected by the speech unit selection section 46), the speech unit fusion section 47 fuses formant parameters (generated by the formant parameter generation section 41), and generates a fused speech unit from the fused formant parameter. The fused speech unit means a speech unit representing each feature of the plurality of speech units to be fused. For example, an average or a weighted sum of average of the plurality of speech units, an average or a weighted sum of average of each band divided from the plurality of speech units, can be the fused speech unit.

(2-7) The Fused Speech Unit Editing/Concatenation Section 48:

The fused speech unit editing/concatenation section 48 transforms/concatenates a sequence of fused speech units based on the input prosodic information, and generates a speech waveform of a synthesized speech. The speech waveform is output by the speech waveform output section 5.

Figures 3, 4:
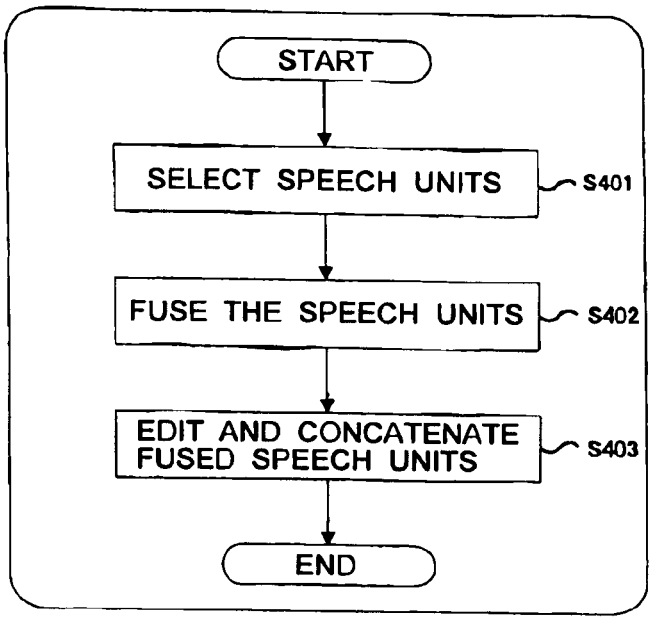
FIG. 3 is a flow chart of processing of the speech synthesis section.
FIG. 4 is an example of speech units stored in a speech unit memory.

(3) Summary of Processing of the Speech Synthesis Section 4:

FIG. 3 is a flow chart of processing of the speech synthesis section 4. At S401, based on the input phoneme sequence/prosodic information, the speech unit selection section 46 selects a plurality of speech units for each segment from the speech unit memory 42. The plurality of speech units (selected for each segment) corresponds to a phoneme of the segment, and has a prosodic feature similar to the input prosodic information of the segment.

Each of the plurality of speech units (selected for each segment) has the minimum distortion between a target speech and a synthesized speech generated by transforming the speech unit based on the input prosodic information. Furthermore, each of the plurality of speech units (selected for each segment) has the minimum distortion between a target speech and a synthesized speech generated by concatenating the speech unit with a speech unit of the next segment. In the first embodiment, a plurality of speech units for each segment is selected by estimating a distortion for the target speech using a cost function (explained afterwards).

Next, at S402, the speech unit fusion section 47 extracts formant parameters corresponding to the plurality of speech units (selected for each segment) from the formant parameter memory 44, fuses the formant parameters, and generates new speech unit of each segment using a fused formant parameter. Next, S403, a sequence of new speech units is transformed and concatenated by the input prosodic information, and a speech waveform is generated.

Hereinafter, processing of the speech synthesis section 4 is explained in detail. A speech unit of a synthesis unit is regarded as one phoneme. In this case, the speech unit may be a half-phoneme, a diphone, a triphone, a syllable, or a variable length as mixture.

(4) Information Stored in the Speech Unit Memory 42:

As shown in FIG. 4, the speech unit memory 42 correspondingly stores a waveform of speech signal of each phoneme and a speech unit number to identify the phoneme. As shown in FIG. 5, the phoneme environment memory 43 stores a phoneme environment information of each speech unit (stored in the speech unit memory 42) in correspondence with the speech unit number. As the phoneme environment information, a phoneme symbol (phoneme name), a fundamental frequency, a phoneme duration, and a concatenation boundary cepstrum, are stored.

The formant parameter memory 44 stores a formant parameter sequence (generated by the formant parameter generation section 41 from each speech unit stored in the speech unit memory 42) in correspondence with the speech unit number.

(5) The Format Parameter Generation Section 41:

The formant parameter generation section 41 generates a formant parameter by inputting each speech unit stored in the speech unit memory 42. FIG. 6 is a flow chart of processing of the formant parameter generation section 41.

At S411, each speech unit is divided into a plurality of frames. At S412, a formant parameter of each frame is generated from a pitch waveform of the frame. As shown in FIG. 10, the formant parameter memory 44 stores the formant parameter of each frame in correspondence with a frame number and a speech unit number. In FIG. 10, a number of formant frequencies in one frame is three. However, the number of formant frequencies may be arbitrary.

As to a window function, a base function is set by multiplying a Hanning window with DCT base having arbitral points, and the window function is represented by the base function and a weighted coefficient vector. The base function may be generated by KL expansion of the window function.

At S411 and S412 in FIG. 6, the formant parameter corresponding to a pitch waveform of each speech unit is stored in the formant parameter memory 44.

(5-1) Division Processing of a Segment Into Frames:

At S411, if a speech unit selected from the speech unit memory 42 is a segment of voiced speech, the speech unit is divided into a plurality of frames as a smaller unit than the speech unit. The frame means a division one (such as a pitch waveform) having a smaller length than a duration of the speech unit.

The pitch waveform means a comparative short waveform having a length as several times as a fundamental period of a speech signal and not having the fundamental frequency. A spectral of the pitch waveform represents a spectral envelope of the speech signal.

As a method for dividing the speech unit into frames, a method for extracting by a fundamental period synchronous window, a method for transforming (inverse-discrete Fourier transform) a power spectral envelop (obtained by Cepstrum analysis or PSE analysis), or a method for determining a pitch waveform by an impulse response (obtained by linear prediction analysis), are applied.

In the present embodiment, each frame is set to a pitch waveform. As a method for extracting the pitch waveform, a speech unit is divided into the pitch waveform by a fundamental period synchronous window. FIG. 7 is a flow chart of processing of extraction of pitch waveform.

Figure 8A:
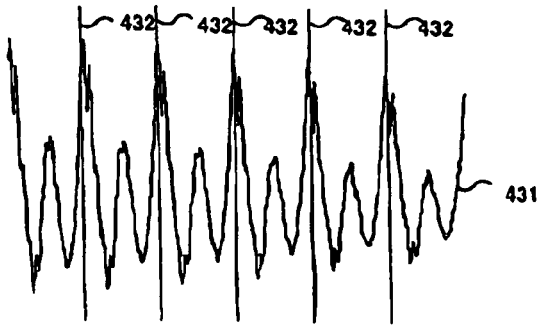
FIGS. 8A, 8B, 8C, and 8D are schematic diagrams of steps to obtain formant parameters from speech units.

At S421, a mark (pitch mark) is assigned to a speech waveform of the speech unit at a period interval. FIG. 8A shows a speech waveform 431 of one speech unit (among M units of speech unit) to which a pitch mark 432 is assigned at a period interval.

Figure 8B:
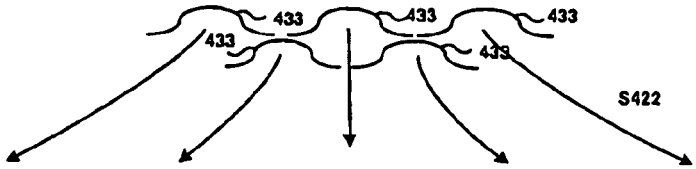
Figure 8C:
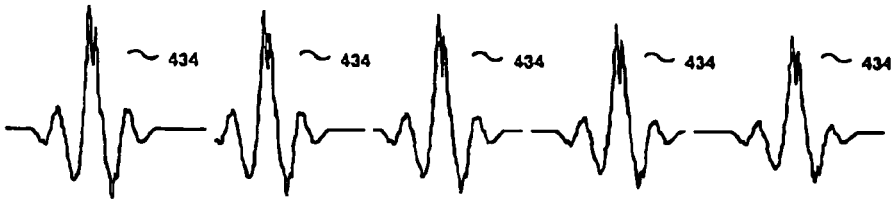

At S422, as shown in FIG. 8B, a pitch waveform is extracted by windowing based on the pitch mark. A hanning window 433 is used for the windowing, and a length of the hanning window is double a length of fundamental period. Next, as shown in FIG. 8C, a windowed waveform 434 is extracted as a pitch waveform.

Figure 8D:
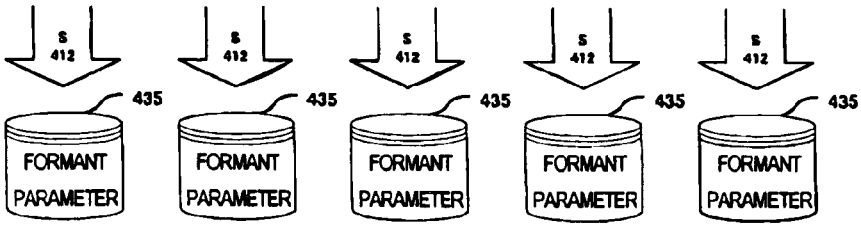

(5-2) Generation of Formant Parameter:

Next, at s412 in FIG. 6, a formant parameter is calculated for each pitch waveform of the speech unit (extracted at S411). As shown in FIG. 8D, a formant parameter 435 is generated for each pitch waveform 434 extracted. In the present embodiment, the formant parameter comprises a formant frequency, a power, a phase, and a window function.

Figure 9A:
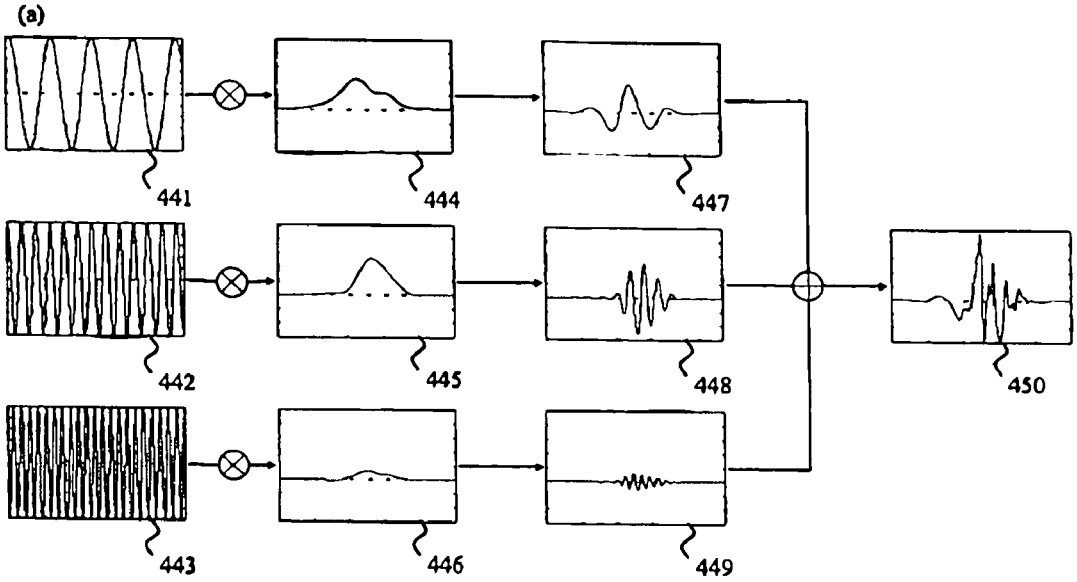
FIGS. 9A and 9B are examples of a sinusoidal wave, a window function, a formant waveform, and a pitch waveform.
Figure 9B:
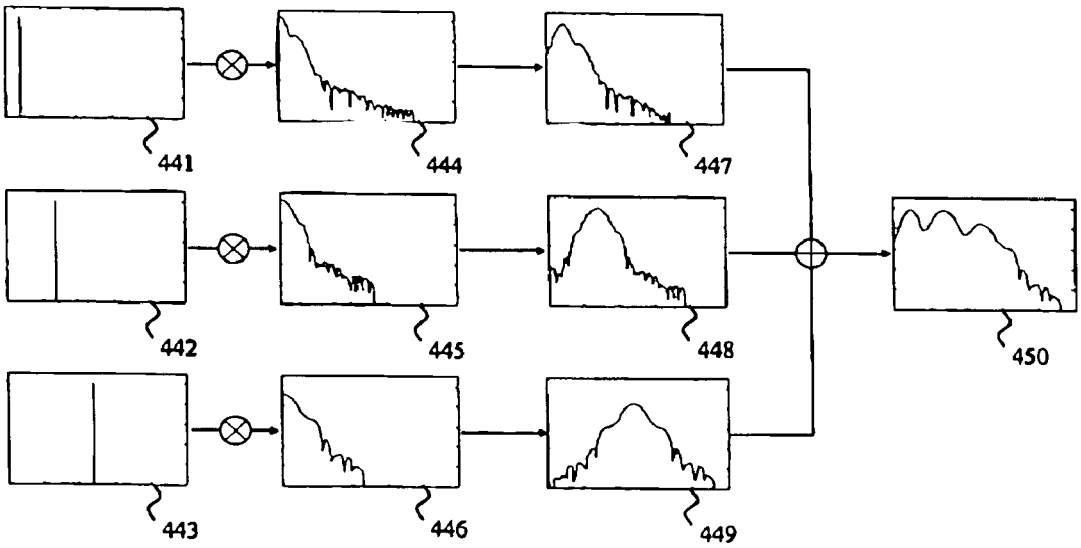

FIGS. 9A and 9B show the relationship between the formant parameter and the pitch waveform in case that the number of formant frequencies is three. In FIG. 9A, a horizontal axis represents time, and a vertical axis represents amplitude. In FIG. 9B, a horizontal axis represents frequency, and a vertical axis represents amplitude.

In FIG. 9A, as for each sinusoidal wave 441, 442, and 443 (of each formant frequency) having power and phase, each formant waveform 447, 448, and 449 is obtained by multiplying each window function 444, 445, and 446, and added to generate a pitch waveform 450. In this case, a power spectral of the formant waveform does not always represent a mount part of a power spectral of a speech signal. A power spectral of a pitch waveform as a sum of a plurality of formant waveforms represents a power spectral of the speech signal.

In FIG. 9B, a power spectral of sinusoidal waves 441, 442, and 443 in FIG. 9A, a power spectral of window functions 444, 445, and 446, a power spectral of formant waveforms 447, 448, and 449, and a power spectral of the pitch waveform 450, are respectively shown.

(5-3) Storage of Format Parameter:

The formant parameter (generated by above-processing) is stored in the formant parameter memory 44. In this case, a formant parameter sequence is stored in correspondence with a unit number of the phoneme.

(6) The Phoneme Sequence/Prosodic Information Input Section:

After morphological analysis/syntax analysis of input text for text speech synthesis, a phoneme sequence and prosodic information (obtained by accent/intonation processing) is input to the phoneme sequence/prosodic information 45 in FIG. 2. The prosodic information includes fundamental frequency and phoneme duration.

(7) The Speech Unit Selection Section 46:

The speech unit selection section 46 determines a speech unit sequence based on a cost function.

(7-1) Cost Function

The cost function is determined as follows. First, in case of generating a synthesized speech by modifying/concatenating speech units, a subcost function $C_n$ ($u_i$, $u_{i-1}$, $t_i$) (n: 1, . . . N, N is the number of subcost function) is determined for each factor of distortion. Assume that a target speech corresponding to input phoneme sequence/prosodic information is "t=($t_1$, . . . , $t_I$)". In this case, "$t_i$" represents phoneme environment information as a target of speech unit corresponding to the i-th segment, and "$u_i$" represents a speech unit of the same phoneme as "$t_i$" among speech units stored in the speech unit memory 42.

(7-1-1) The Subcost Function:

The subcost function is used for estimating a distortion between a target speech and a synthesized speech generated using speech units stored in the speech unit memory 42. In order to calculate the cost, a target cost and a concatenation cost may be used. The target cost is used for calculating a distortion between a target speech and a synthesized speech generated using the speech unit. The concatenation cost is used for calculating a distortion between the target speech and the synthesized speech generated by concatenating the speech unit with another speech unit.

As the target cost, a fundamental frequency cost and a phoneme duration cost are used. The fundamental frequency cost represents a difference of frequency between a target and a speech unit stored in the speech unit memory 42. The phoneme duration cost represents a difference of phoneme duration between the target and the speech unit. As the concatenation cost, a spectral concatenation cost representing a difference of spectral at concatenation boundary is used.

(7-1-2) Example of the Subcost function:

The fundamental frequency cost is calculated as follows.

$$C_1(u_i,u_{i-1},t_i)=\{\log(f(v_i))-\log(f(t_i))\}^2 \quad (1)$$

$v_i$: unit environment of speech unit $u_i$ f: function to extract a fundamental frequency from unit environment $v_i$ The phoneme duration cost is calculated as follows.

$$C_2(u_i,u_{i-1},t_i)=\{g(v_i)-g(t_i)\}^2 \quad (2)$$

g: function to extract a phoneme duration from unit environment $v_i$

The spectral concatenation unit is calculated from a cepstrum distance between two speech units as follows.

$$C_3(u_i,u_{i-1},t_i)=\|h(u_i)-h(u_{i-1})\| \quad (3)$$

||: norm h: function to extract cepstrum coefficient (vector) of concatetion boundary of speech unit $u_i$ (7-1-3) A Synthesis Unit Cost Function:

A weighted sum of these subcost functions is defined as a synthesis unit cost function as follows.

$$C(u_i, u_{i-1}, t_i) = \sum_{n=1}^{N} w_n \cdot C_n(u_i, u_{i-1}, t_i) \quad (4)$$

$w_n$: weight between subcost functions

In order to simplify the explanation, all "$w_n$" is set to "1". The above equation (4) represents calculation of synthesis unit cost of a speech unit when the speech unit is applied to some synthesis unit.

As to a plurality of segments divided from an input phoneme sequence by a synthesis unit, the synthesis unit cost of each segment is calculated by equation (4). A (total) cost is calculated by summing the synthesis unit cost of all segments as follows.

$$TC = \sum_{i=1}^{I} (C(u_i, u_{i-1}, t_i)) \quad (5)$$

Figure 11:
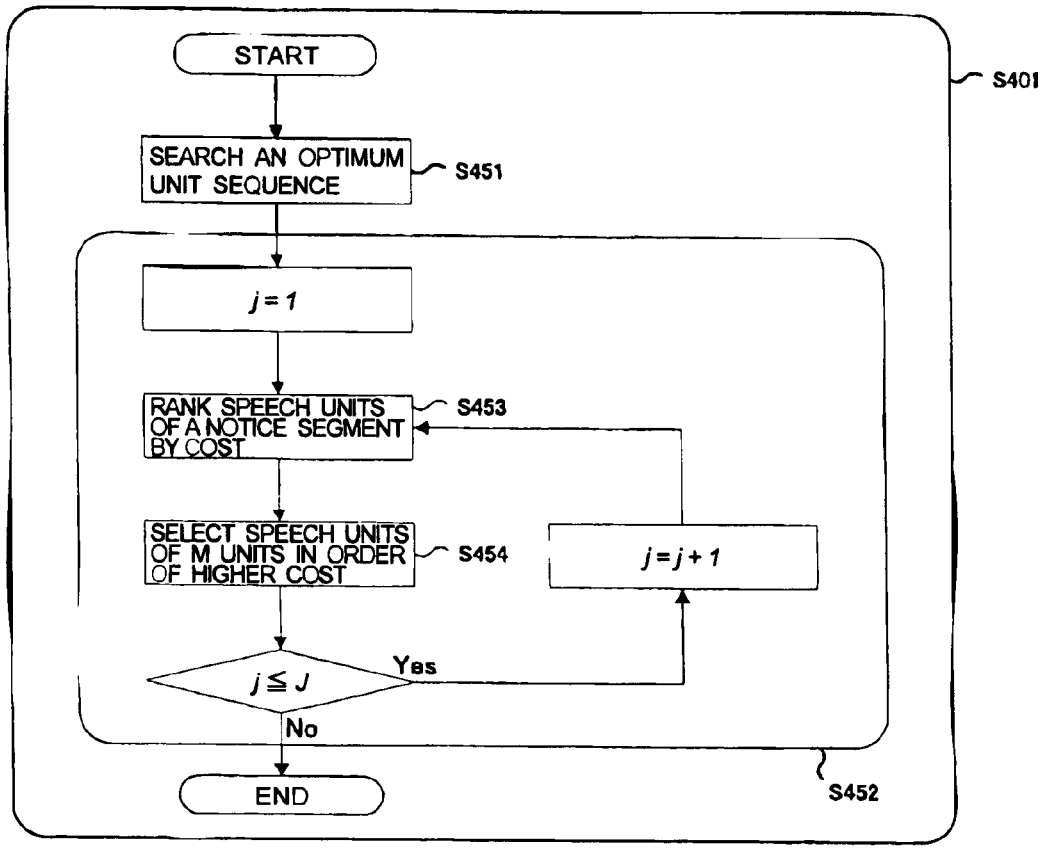
FIG. 11 is a flow chart of processing of a speech unit selection section.

(7-2) Selection:

At S401 in FIG. 3, by using cost functions of the above equations (1)~(5), a plurality of speech units is selected for one segment (one synthesis unit) by two steps. FIG. 11 is a flow chart of processing of selection of the plurality of speech units.

At S451, a speech unit sequence having minimum cost value (calculated by the equation (5)) is selected from speech units stored in the speech unit memory 42. This speech unit sequence (combination of speech units) is called "optimum unit sequence". Briefly, each speech unit in the optimum unit sequence corresponds to each segment divided from the input phoneme sequence by a synthesis unit. The synthesis unit cost of each speech unit in the optimum unit sequence and the total cost (calculated by the equation (5)) are smallest among any of other speech unit sequences. In this case, the optimum unit sequence is effectively searched using DP (Dynamic Programming) method.

Next, at S452, as unit selection, a plurality of speech units is selected for one segment using the optimum unit sequence. Assume that the number of segments is J, and speech units of M units are selected for each segment. Detail processing of S452 is explained.

At S453 and S454, one of the segments of J units is set to a notice segment. Processing of S453 and S454 is repeated J-times so that each of the segments of J units is set to a notice segment. First, at S453, each speech unit in the optimum unit sequence is fixed to each segment except for the notice segment. In this condition, as to the notice segment, speech units stored in the speech unit memory 42 are ranked with the cost calculated by the equation (5), and speech units of M units are selected in order of higher cost.

Figure 12:
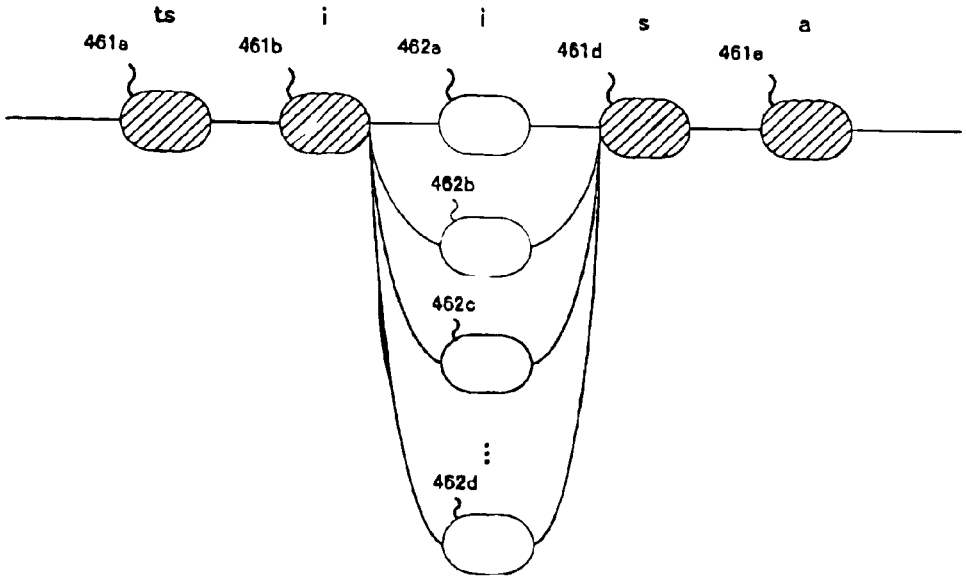
FIG. 12 is a schematic diagram of steps to obtain a plurality of speech units for each of a plurality of segments corresponding to an input phoneme sequence.

(7-3) Example:

For example, as shown in FIG. 12, assume that an input phoneme sequence is "ts.i.i.s.a . . . ". In this case, a synthesis unit corresponds to each phoneme "ts", "i", "i", "s", "a", . . . , and each phoneme corresponds to one segment. In FIG. 12, a segment corresponding to the third phoneme "i" in the input phoneme sequence is a notice segment, and a plurality of speech units is selected for the notice segment. As to segments except for the notice segment, each speech unit 461*a*, 461*b*, 461*d*, 461*e*, . . . in the optimum unit sequence is fixed.

In this condition, among speech units stored in the speech unit memory 42, a cost is calculated for each speech unit having the same phoneme "i" as the notice segment by using the equation (5). In case of calculating the cost for each speech unit, a target cost of the notice segment, a concatenation cost between the notice segment and a previous segment, and a concatenation cost between the notice segment and a following segment respectively vary. Accordingly, only these costs are taken into consideration in the following steps.

(Step 1) Among speech units stored in the speech unit memory 42, a speech unit having the same phoneme "i" as the notice segment is set to a speech unit "$u_3$". A fundamental frequency cost is calculated from a fundamental frequency $f(v_3)$ of the speech unit $u_3$ and a target fundamental frequency $f(t_3)$ by the equation (1).

(Step 2) A phoneme duration cost is calculated from a phoneme duration $g(v_3)$ of the speech unit $u_3$ and a target phoneme duration $g(t_3)$ by the equation (2).

(Step 3) A first spectral concatenation cost is calculated from a cepstrum coefficient $h(u_3)$ of the speech unit $u_3$ and a cepstrum coefficient $h(u_2)$ of a speech unit 461*b* ($u_2$) by the equation (3). Furthermore, a second spectral concatenation cost is calculated from the cepstrum coefficient $h(u_3)$ of the speech unit $u_3$ and a cepstrum coefficient $h(u_4)$ of a speech unit 461*d* ($u_4$) by the equation (3).

(Step 4) By calculating weighted sum of the fundamental frequency cost, the phoneme duration cost, and the first and second spectral concatenation costs, a cost of the speech unit u3 is calculated.

(Step 5) As to each speech unit having the same phoneme "i" as the notice segment among speech units stored in the speech unit memory 42, the cost is calculated by above steps 1~4. These speech units are ranked in order of smaller cost, i.e., the smaller a cost is, the higher a rank of the speech unit is (S453 in FIG. 11). Then, speech units of M units are selected in order of higher rank (S454 in FIG. 11). For example, in FIG. 12, a speech unit 462*a* has the highest rank, and a speech unit 462*d* has the lowest rank. Above steps 1~5 are repeated for each segment. As a result, speech units of M units are respectively obtained for each segment.

As the phoneme environment information, a phoneme name, a fundamental frequency, and a duration, are explained. However, the phoneme environment information is not limited to these factors. If necessary, a phoneme name, a fundamental frequency, a phoneme duration, a previous phoneme, a following phoneme, a second following phoneme, a power, a stress, a position from accent core, a time from breath point, an utterance speed, and a feeling, may be selectively used.

(8) The Speech Unit Fusion Section 47:

Next, processing of the speech unit fusion section 47 (at S402 in FIG. 3) is explained. At S402, as to speech units of M units selected for each segment at S401, the speech units of M units are fused for each segment, and a new speech unit (fused speech units) is generated. The case of the speech unit as a voiced speech and the case of the speech unit as an unvoiced speech are differently processed.

Figure 13:
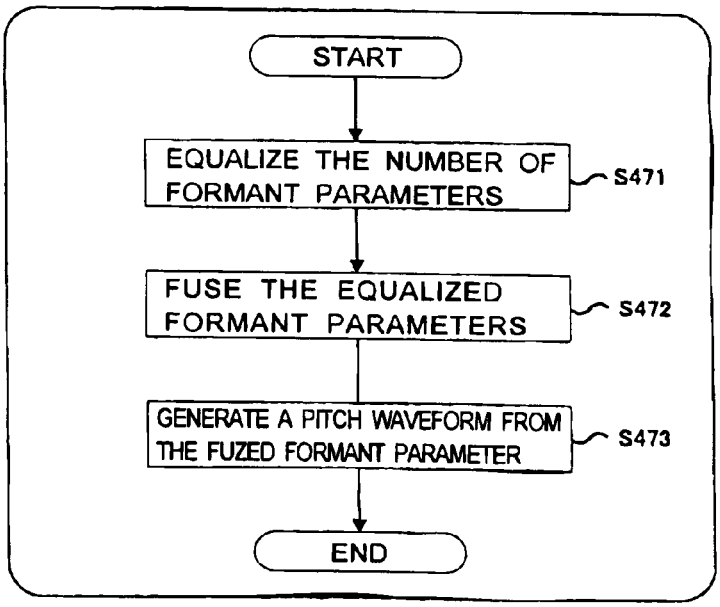
FIG. 13 is a flow chart of processing of a speech unit fusion section.

First, the case of the voiced speech is explained. In this case, the formant parameter generation section 41 (in FIG. 2) fuses formant parameters of a frame as a pitch waveform divided from the speech unit. FIG. 13 is a flow chart of processing of the speech unit fusion section 47.

(8-1) Extraction of Formant Parameter:

At S471, formant parameters corresponding to speech units of M units in each segment (selected by the speech unit selection section 46) are extracted from the formant parameter memory 44. A formant parameter sequence is stored in correspondence with a speech unit number. Accordingly, the formant parameter sequence is extracted based on the speech unit number.

(8-2) Coincidence of the Number of Formant Parameters:

At S471, among the formant parameter sequence of each speech unit of M units in the segment, the number of formant parameters in the formant parameter sequence of each speech unit is equalized to coincide with the largest number of formant parameters. As to a formant parameter sequence having the smaller number of formant parameters, the smaller number of formant parameters is increased to be equal to the largest number of formant parameters by copying the formant parameter.

Figure 14:
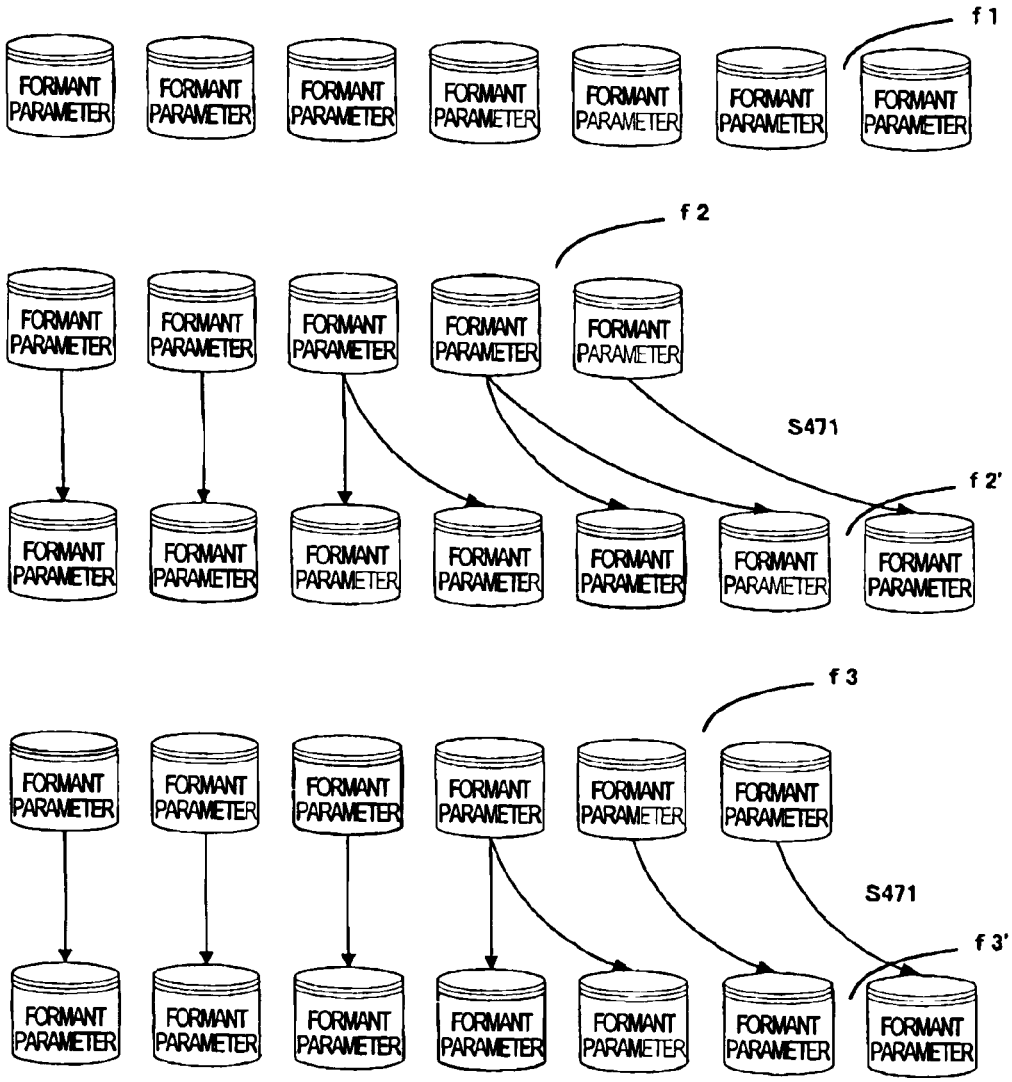
FIG. 14 is a schematic diagram to explain processing of the speech unit fusion section.

FIG. 14 shows formant parameter sequences f1~f3 corresponding to the same frame in speech units of M units (In this case, three) of the segment. The number of formant parameters of a formant parameter sequence f1 is seven, the number of formant parameters of a formant parameter sequence f2 is five, and the number of formant parameters of a formant parameter sequence f3 is six. In this case, the formant parameter sequence f1 has the largest number of formant parameters. Accordingly, based on the number (In FIG. 14, seven) of formant parameters of the sequence f1, the number of formant parameters of sequences f2 and f3 is respectively increased to be equal to seven by copying any of formant parameters of each sequence. As a result, new formant parameter sequences f2' and f3' corresponding to the sequences f2 and f3 are obtained.

Figure 15:
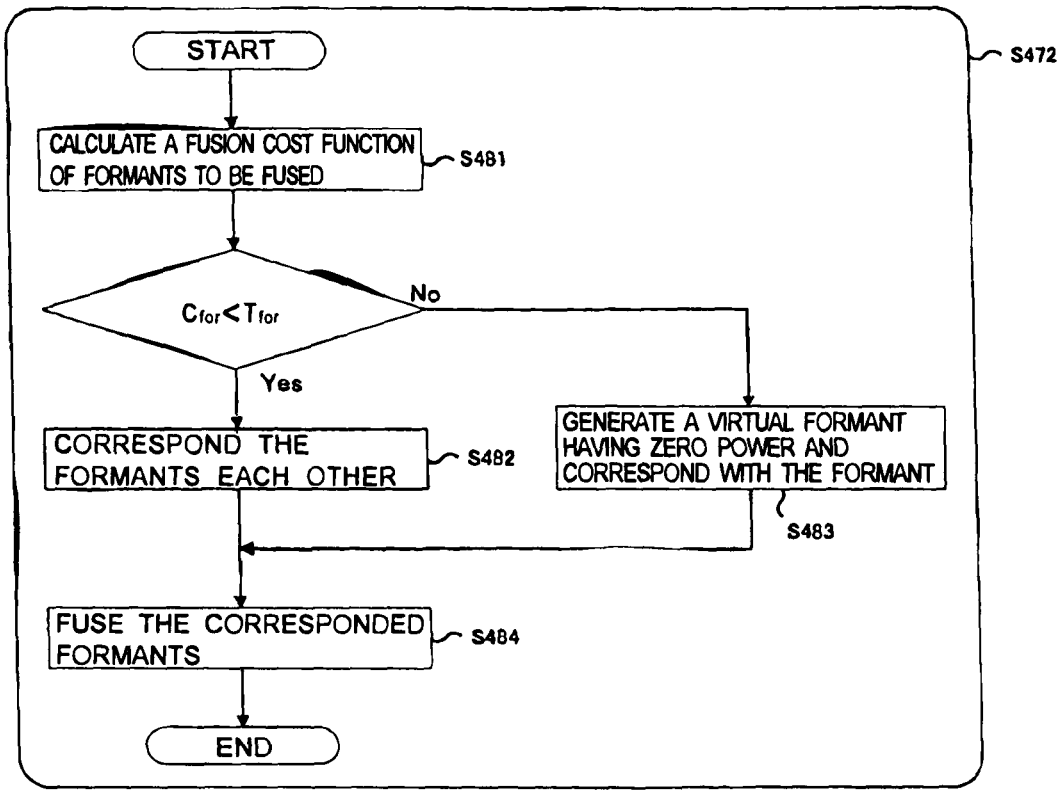
FIG. 15 is a flow chart of fusion processing of formant parameters.

(8-3) Fusion:

At S472, formant parameters of each frame in each speech unit (M units) are fused after the number of formant parameters of each speech unit is equalized at S471. FIG. 15 is a flow chart of processing of S472 to fuse the formant parameters.

At S481, as to each formant between two formant parameters to be fused, a fusion cost function to estimate a similarity of the formant is calculated. As the fusion cost function, a formant frequency cost and a power cost are used. The formant frequency cost represents a difference (i.e., similarity) of formant frequency between two formant parameters to be fused. The power cost represents a difference (i.e., similarity) of power between two formant parameters to be fused.

For example, the formant frequency cost is calculated as follows.

$$C_{for}=|r(q_{xyi})-r(q_{x'y'i'})| \quad (6)$$

$q_{xyi}$: i-th formant in y-th frame of speech unit $p_x$ r: function to extract a formant frequency from a formant parameter $q_{xyi}$ Furthermore, the power cost is calculated as follows.

$$C_{pow}=|s(q_{xyi})-s(q_{x'y'i'})| \quad (7)$$

s: function to extract a power frequency from a formant parameter $q_{xyi}$

A weighted sum of the equations (6) and (7) is defined as a fusion cost function to correspond two formant parameters.

$$C_{map}=z_1C_{for}+z_2C_{pow} \quad (8)$$

$z_1$: weight of formant frequency cost $z_2$: weight of power cost

In order to simplify the explanation, $z_1$ and $z_2$ are respectively set to "1".

At S482, as to formants having the fusion cost function smaller than $T_{for}$ (i.e., the formants have similar formant shape formant), two formant functions having minimum value of the fusion cost function are corresponded.

At S483, as to formants having the fusion cost function larger than $T_{for}$ (i.e., the formants do not have similar shape formant), a virtual formant having zero power is created for one (having the smaller number of formant parameters) of two formants to be fused, and corresponded with the other of the two formants.

At S484, corresponded formants are fused by calculating each average of a formant frequency, a phase, a power, and a window function. Alternatively, one formant frequency, one phase, one power, and one window function, may be selected from the corresponded formants.

(Example of Fusion)

FIG. 16 shows a schematic diagram of generation of a fused formant parameter 487. At s481, a fusion cost function between two formant parameters 485 and 486 of the same frame in two speech units is calculated. At S482, two formants having similar shape between the two-formant parameters 485 and 486 are corresponded. At S483, a virtual formant is created in the formant parameter 485', and corresponded with the formant parameter 486. At S484, each two formants are fused between the two formant parameters 485' and 486, and a fused formant parameter 487 is generated.

In case of creating a virtual formant in the formant parameter 485, a value of formant frequency of formant number "3" in the formant parameter 486 is directly used. However, another method may be used.

(8-5) Generation of a Fused Pitch Waverform Sequence:

Next, at S473 in FIG. 13, a fused pitch waveform sequence h1 is generated from a fused formant parameter sequence g1 (fused at S472).

Figure 17:
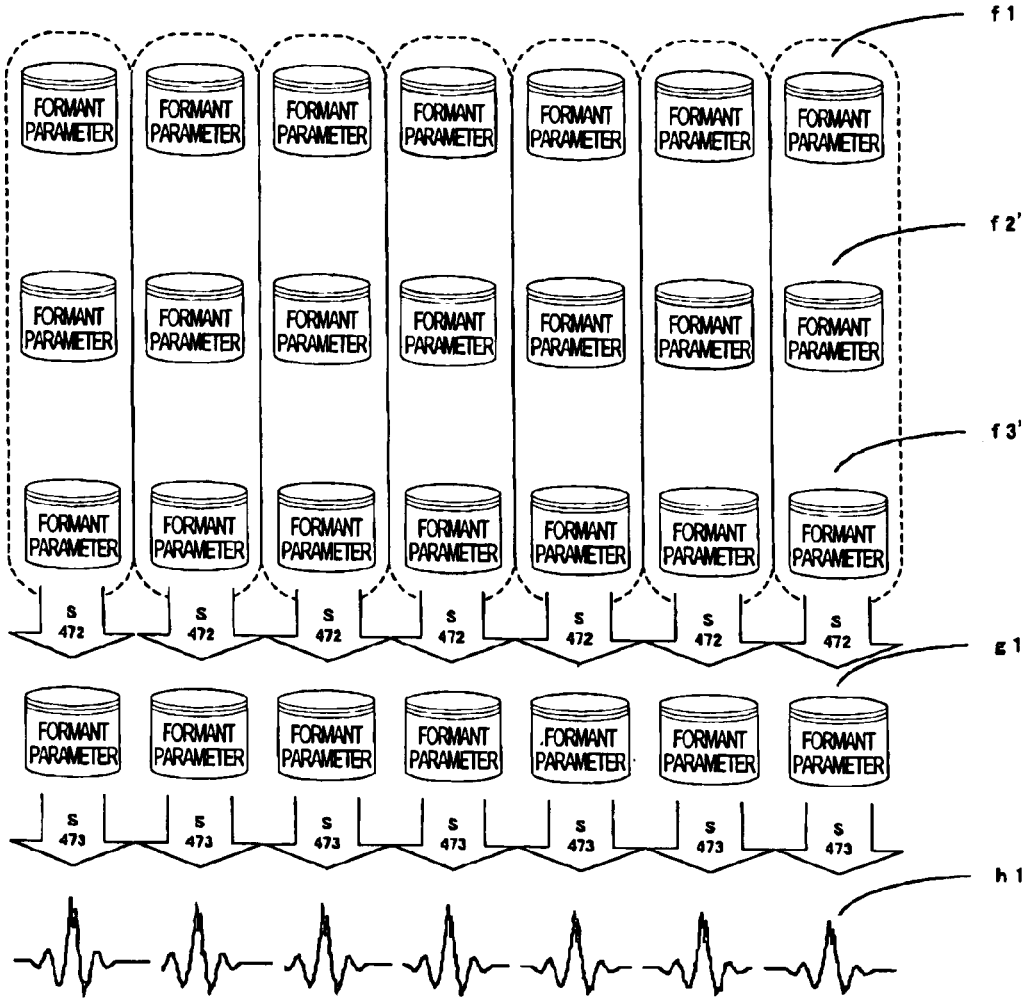
FIG. 17 is a schematic diagram to explain generation processing of fused pitch waveforms.

FIG. 17 shows a schematic diagram of generation of the fused pitch waveform sequence h1. As to each formant parameter sequence f1, f2', and f3' having the equalized number of formants, at S472, formant parameters of each frame are fused, and a fused formant parameter sequence g1 is generated. At S473, the fused pitch waveform sequence h1 is generated from the fused formant parameter sequence g1.

Figure 18:
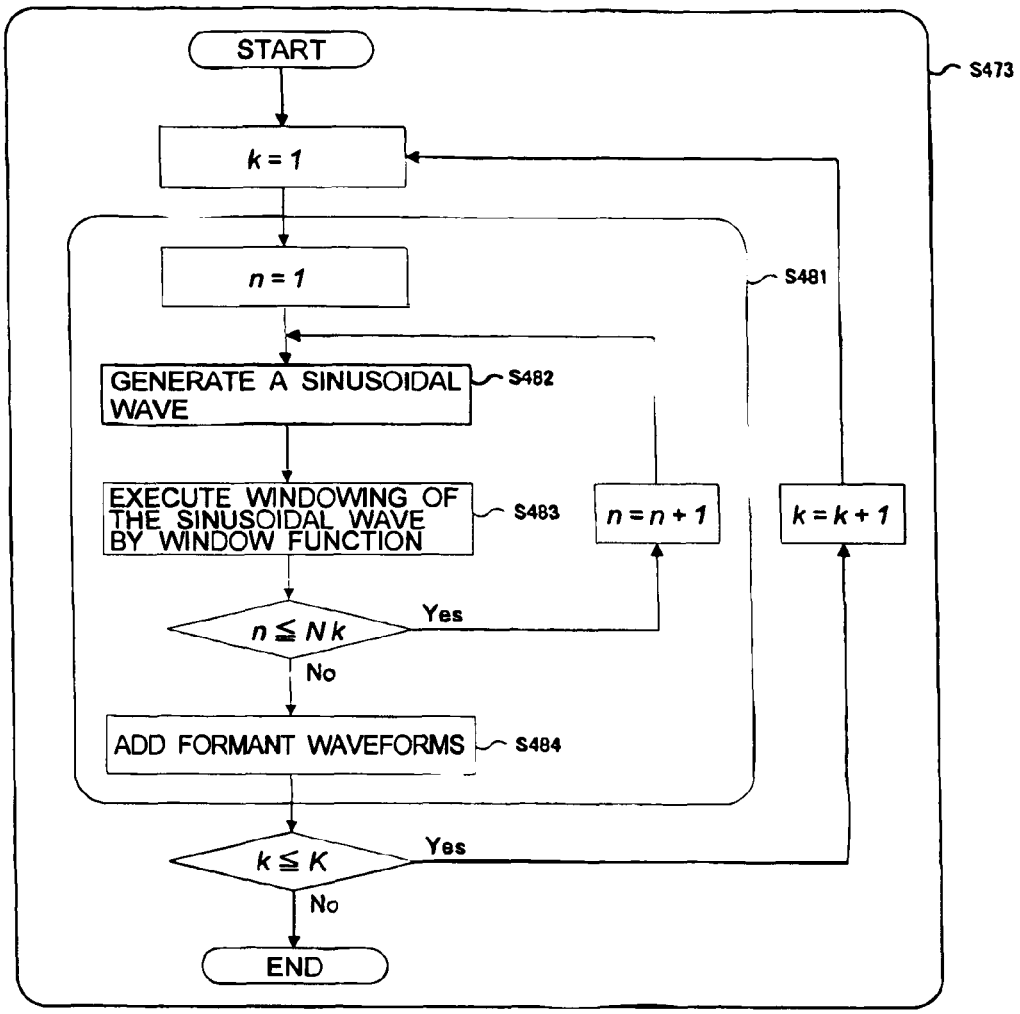
FIG. 18 is a flow chart of generation processing of pitch waveforms.

FIG. 18 is a flow chart of generation processing of pitch waveforms from formant parameters in case that the number of elements in the fused formant parameter sequence g1 is K (In FIG. 17, seven).

First, at S473, one of the formant parameters of K frames is set to a notice formant parameter, and processing of S481 is repeated K times. Briefly, processing of S481 is executed so that each of formant parameters of K frames is set to the notice formant parameter.

Next, at S481, one of formant frequencies of $N_k$ formants in the notice formant parameter is set to a notice formant frequency, and processing of S482 and S483 is repeated $N_k$ times. Briefly, processing of S482 and S483 is executed so that each of formant frequencies of $N_k$ formants is set to the notice formant frequency.

Next, at S482, a sinusoidal wave having a power and a phase (corresponding to a formant frequency in the notice formant parameter) is generated. Briefly, a sinusoidal wave having the formant frequency is generated. A method for generating the sinusoidal wave is not limited to this. However, in case of lowering calculation accuracy or using a table to reduce the calculation quantity, a perfect sinusoidal wave is often not generated because of a calculation error.

Next, at S483, by windowing with a window function (corresponding to a notice formant frequency in the formant parameter) to the sinusoidal wave (generated at S482), a formant waveform is generated.

At S484, formant waveforms of $N_k$ formants (generated at S482 and S483) are added and a fused pitch waveform is generated. In this way, by repeating processing of S481 K times, the fused pitch waveform sequence h1 is generated from the fused formant parameter sequence g1.

On the other hand, at S402 in FIG. 3, in case of the segment of unvoiced speech, in speech units of M units assigned to the segment at S401, one speech unit having the first order is selected and used.

As mentioned-above, as to each of a plurality of segments corresponding to an input phoneme sequence, speech units of M units selected for the segment are fused, and a new speech unit (fused speech unit) is generated for the segment. Next, processing is forwarded to editing/concatenating step (S403) of fused speech unit in FIG. 3.

(9) The Fused Speech Unit Editing/Concatenation Section 48:

At S403, the fused speech unit editing/concatenation section 48 modifies a fused speech unit of each segment (obtained at S402) based on input prosodic information, and concatenates a modified fused speech unit of each segment to generate a speech waveform.

As to a fused speech unit (obtained at S402), actually, each element of the sequence shapes a pitch waveform as shown in a fused pitch waveform sequence h1 in FIG. 17. Accordingly, by overlapping and adding pitch waveforms so that a fundamental frequency and a phoneme duration of the fused speech unit are respectively equal to a fundamental frequency and a phoneme duration of a target speech (in the input prosodic information), a speech waveform is generated.

Figure 19:
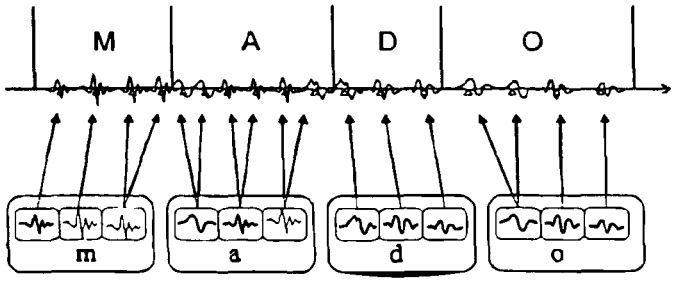
FIG. 19 is a schematic diagram to explain processing of a fused speech unit editing/concatenation section.

FIG. 19 is a schematic diagram of processing of S403. In FIG. 19, by modifying/concatenating a fused speech unit of each segment (each phoneme "m", "a", "d", "o"), a speech unit "MADO" (meaning is "window" in Japanese) is generated. As shown in FIG. 19, based on a fundamental frequency and a phoneme duration of a target speech in input prosodic information, a fundamental frequency of each pitch waveform and the number of pitch waveforms in a fused speech unit of each segment are modified. After that, by concatenating adjacent pitch waveforms within the segment and between two segments, synthesized speech is generated.

In order to estimate a distortion between a target speech and a synthesized speech (generated by modifying a fundamental frequency and a phoneme duration of the fused speech unit based on input prosodic information), the target cost is desired to correctly estimate the distortion. As one example, the target cost calculated by equations (1) and (2) is used for calculating the distortion by difference of prosodic information between a target speech and speech units stored in the speech unit memory 42.

Furthermore, in order to estimate a distortion between a target speech and a synthesized speech generated by concatenating fused speech units, the concatenation cost is desired to correctly estimate the distortion. As one example, the concatenation cost calculated by equation (3) is used for calculating the distortion by difference of cepstrum coefficient between two speech units stored in the speech unit memory 42.

(10) Difference Compared with Prior Art:

Next, difference between the present embodiment and a speech synthesis method of prior art as plural unit selection and fusion method is explained. The speech synthesis apparatus of the present embodiment in FIG. 2 includes the formant parameter generation section 41 and the formant parameter memory 44. Generation of new speech unit by fusing formant parameters is different from the prior art (For example, JP-A No. 2005-164749 (Kokai)).

In the present embodiment, by fusing formant parameters of a plurality of speech units (M units) for each segment, a speech unit having clear spectral and clear formant is generated. As a result, a high quality synthesizes speech with more naturalness can be generated.

(Second Embodiment)

Figure 20:
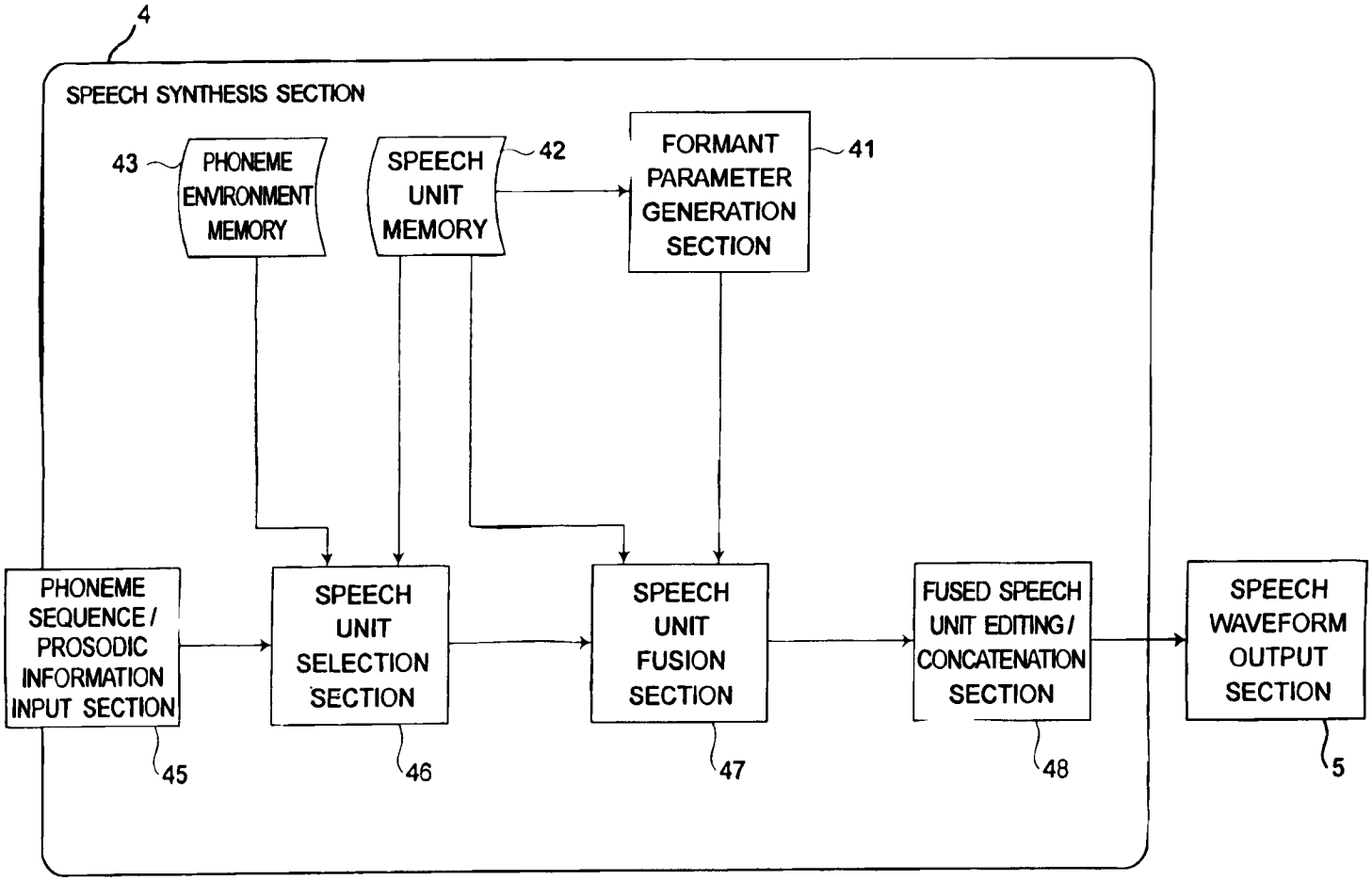
FIG. 20 is a block diagram of the speech synthesis section according to a second embodiment.

Next, a speech synthesis apparatus 4 of the second embodiment is explained. FIG. 20 is a block diagram of the speech synthesis apparatus 4 of the second embodiment. In the first embodiment, the formant parameter generation section 41 previously generates formant parameters of all speech units stored in the speech unit memory 42, and the formant parameters are stored in the formant parameter memory 44.

In the second embodiment, speech units selected by the speech unit selection section 46 are input from the speech unit memory 42 to the formant parameter generation section 41. The formant parameter generation section 41 generates only formant parameters of selected speech units, and outputs to the speech unit fusion section 47. Accordingly, in the second embodiment, the formant parameter memory 44 of the first embodiment is not necessary. As a result, in addition to effect of the first embodiment, memory capacity can be greatly reduced.

(Third Embodiment)

Next, a speech unit fusion section 47 of the third embodiment is explained. As another method for generating a synthesized speech, the formant synthesis method is well known. The formant synthesis method is a model of person's utterance mechanism. In this method, a speech signal is generated by driving a filter to model characteristic of vocal tract with a sound source signal (modeled by an utterance signal from glottis). As one example, a speech synthesizer using the formant synthesis method is disclosed in JP-A (Kokai) No. 2005-152396.

Figure 21:
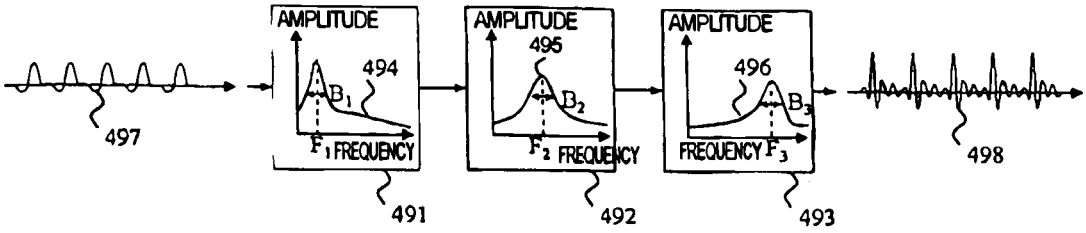
FIG. 21 is a block diagram of a formant synthesizer according to a third embodiment.

FIG. 21 is a process flow of the speech unit fusion section 47 of the third embodiment. In FIG. 21, principle to generate a speech signal by the formant synthesis method at S473 in FIG. 13 is shown.

By driving a vocal tract filter (resonators 491, 492, and 493 are cascade-connected) with a pulse signal 497, a synthesized speech signal 498 is generated. A frequency characteristic 494 of the resonator 491 is determined by a formant frequency F1 and a formant bandwidth B1. In the same way, a frequency characteristic 495 of the resonator 492 is determined by a formant frequency F2 and a formant bandwidth B2, and a frequency characteristic 496 of the resonator 493 is determined by a formant frequency F3 and a formant bandwidth B3.

In case of fusing formant parameters, at S484 in FIG. 15, each average of formant frequencies, powers, and formant bandwidths in corresponded formants is calculated. Alternatively, respective one may be selected from the formant frequencies, the powers, and the formant bandwidths in the corresponded formants.

(Fourth Embodiment)

Figure 22:
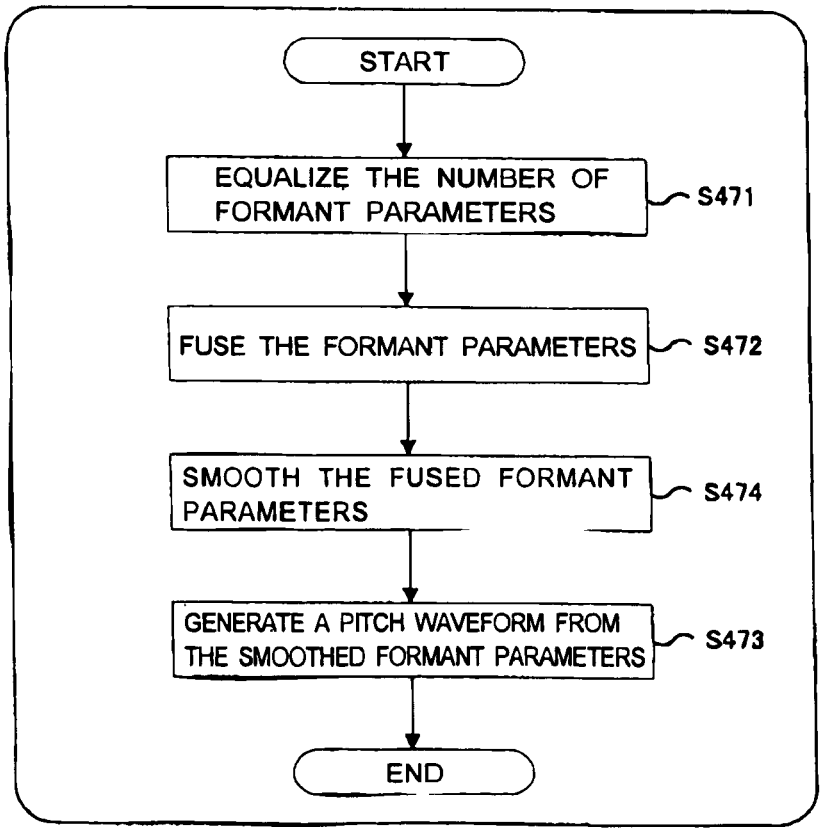
FIG. 22 is a flow chart of processing of the speech unit fusion section according to a fourth embodiment.

Next, a speech unit fusion section 47 of the fourth embodiment is explained. FIG. 22 is a flow chart of processing of the speech unit fusion section 47. As for the same steps in FIG. 13, the same step number is used in FIG. 22, and different step is only explained.

In the fourth embodiment, a formant parameter smoothing step (S474) is newly added. At S474, in order to smooth temporal change of each formant parameter, the formant parameter is smoothed. In this case, all or a part of elements of the formant parameter may be smoothed.

Figure 23:
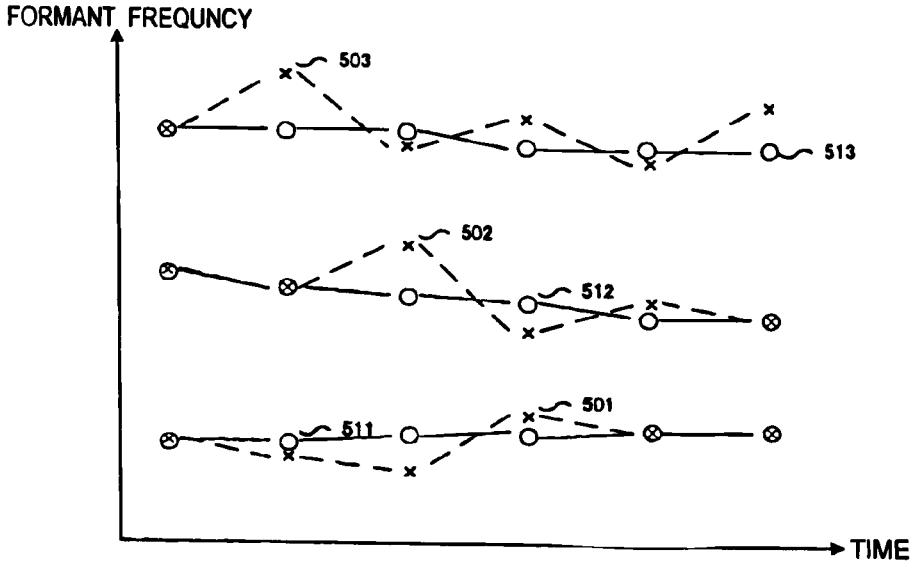
FIG. 23 is a schematic diagram of a smoothing example of formant frequency.

FIG. 23 shows an example of formant smoothing in case that the number of formant frequencies in the formant parameter is three. In FIG. 23, "X" represents each formant frequency 501, 502 and 503 before smoothing. In order to smooth change of formant frequency with a previous frame or a following frame, smoothed formant frequencies 511, 512 and 513 represented by "○" are generated.

Figure 24:
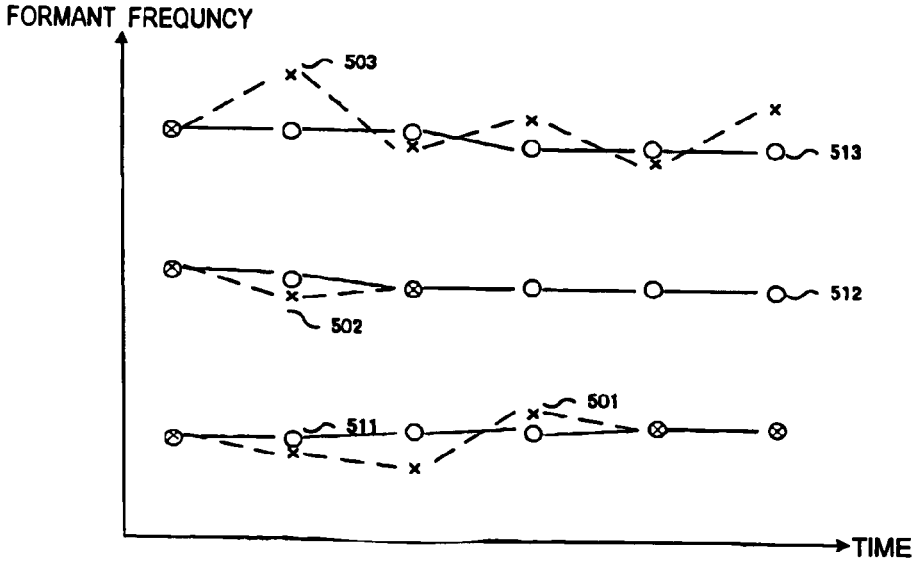
FIG. 24 is a schematic diagram of another smoothing example of formant frequency.
Figure 25:
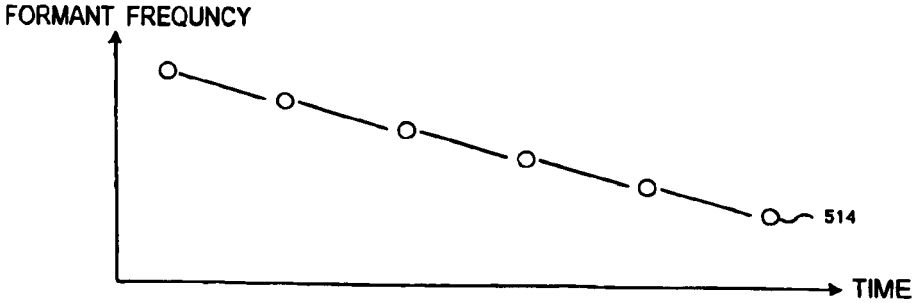
FIG. 25 is a schematic diagram of a power of window function corresponding to the formant frequency in FIG. 24.

Furthermore, as shown in "X" of the formant frequency 502 in FIG. 24, in case that formants are not partially included by a concatenation part of the formant frequency 502, the formant frequency 502 cannot be corresponded with other formant frequencies 511 and 513. By a large discontinuity in spectral, speech quality of synthesized speech falls. In order to prevent this problem, virtual formants represented by "○" are added as shown in the formant frequency 512. In this case, as shown in FIG. 25, a power of a window function 514 corresponding to the formant frequency 512 is attenuated in order not to discontinue the power of formant.

In the disclosed embodiments, the processing can be accomplished by a computer-executable program, and this program can be realized in a computer-readable memory device.

In the embodiments, the memory device, such as a magnetic disk, a flexible disk, a hard disk, an optical disk (CD-ROM, CD-R, DVD, and so on), an optical magnetic disk (MD and so on) can be used to store instructions for causing a processor or a computer to perform the processes described above.

Furthermore, based on an indication of the program installed from the memory device to the computer, OS (operation system) operating on the computer, or MW (middle ware software), such as database management software or network, may execute one part of each processing to realize the embodiments.

Furthermore, the memory device is not limited to a device independent from the computer. By downloading a program transmitted through a LAN or the Internet, a memory device in which the program is stored is included. Furthermore, the memory device is not limited to one. In the case that the processing of the embodiments is executed by a plurality of memory devices, a plurality of memory devices may be included in the memory device. The component of the device may be arbitrarily composed.

A computer may execute each processing stage of the embodiments according to the program stored in the memory device. The computer may be one apparatus such as a personal computer or a system in which a plurality of processing apparatuses are connected through a network. Furthermore, the computer is not limited to a personal computer. Those skilled in the art will appreciate that a computer includes a processing unit in an information processor, a microcomputer, and so on. In short, the equipment and the apparatus that can execute the functions in embodiments using the program are generally called the computer.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

What is claimed is:

1. A method for synthesizing a speech, comprising:

dividing a phoneme sequence corresponding to a target speech into a plurality of segments;

selecting a plurality of speech units for each segment from a speech unit memory storing speech units having at least one frame, the plurality of speech units having a prosodic feature accordant or similar to the target speech;

generating a formant parameter having at least one formant frequency for each frame of the plurality of speech units;

corresponding the formant frequencies of the formant parameters among corresponding frames of the plurality of speech units;

generating a fused formant parameter of each frame from corresponded formant frequencies of formant parameters of each frame of the plurality of speech units;

generating a fused speech unit of each segment from the fused formant parameter of each frame; and generating a synthesized speech by concatenating the fused speech unit of each segment.

2. The method according to claim 1, wherein generating a formant parameter comprises extracting a formant parameter of each of the plurality of speech units from a formant parameter memory storing formant parameters each corresponding to a speech unit.

3. The method according to claim 2, wherein the formant parameter memory correspondingly stores each of the formant parameters, a speech unit number to identify a speech unit, and a frame number to identify a frame in the speech unit.

4. The method according to claim 3, wherein the formant parameter includes the formant frequency and a shape parameter representing a shape of a formant of the speech unit.

5. The method according to claim 4, wherein the formant parameter memory stores a plurality of formant parameters corresponding to the same speech unit number.

6. The method according to claim 4, wherein the shape parameter includes at least a window function, a phase, and a power.

7. The method according to claim 4, wherein the shape parameter includes at least a power and a formant bandwidth.

8. The method according to claim 1, wherein generating a formant parameter comprises, if a number of frames in each of the plurality of speech units is different, equalizing the number of frames of each of the plurality of speech units; and corresponding each frame among the plurality of speech units by the same frame position.

9. The method according to claim 1, wherein generating a fused formant parameter comprises, if a number of formant frequencies of the formant parameter among corresponded frames of the plurality of speech units is different, corresponding each formant frequency of the formant parameter among the corresponded frames so that the number of formant frequencies of the formant parameter among the corresponded frames is equalized.

10. The method according to claim 9, wherein corresponding each formant frequency comprises estimating a similarity of each formant frequency of the formant parameter between two of the corresponded frames; and corresponding two formant frequencies having a similarity above a threshold in the two corresponded frames.

11. The method according to claim 10, wherein corresponding two formant frequencies comprises, if the similarity is not above the threshold, generating a virtual formant having zero power and the same formant frequency as one of the two formant frequencies; and corresponding the virtual formant with the one of the two formant frequencies.

12. The method according to claim 6, wherein generating a fused speech unit comprises generating a sinusoidal wave from the formant frequency, the phase and the power included in the formant parameter of each of the plurality of speech units;

generating a formant waveform of each of the plurality of speech units by multiplying the window function with the sinusoidal wave;

generating a pitch waveform of each frame by adding the formant waveform of each of the plurality of speech units; and generating the fused speech unit by overlapping and adding the pitch waveform of each frame.

13. The method according to claim 1, wherein generating a fused formant parameter comprises smoothing change of the formant parameter included in the formant parameter of each frame.

14. The method according to claim 1, wherein selecting comprises estimating a distortion degree between the target speech and the synthesized speech generated using the plurality of speech units; and selecting the plurality of speech units for each segment so that the distortion degree is minimized.

15. An apparatus for synthesizing a speech, comprising:

a division section configured to divide a phoneme sequence corresponding to a target speech into a plurality of segments;

a speech unit memory that stores speech units having at least one frame;

a speech unit selection section configured to select a plurality of speech units for each segment from the speech unit memory, the plurality of speech units having a prosodic feature accordant or similar to the target speech;

a formant parameter generation section configured to generate a formant parameter having at least one formant frequency for each frame of the plurality of speech units;

a fused formant parameter generation section configured to correspond formant frequencies of the formant parameters among corresponding frames of the plurality of speech units, and to generate a fused formant parameter of each frame from corresponded formant frequencies of formant parameters of each frame of the plurality of speech units;

a fused speech unit generation section configured to generate a fused speech unit of each segment from the fused formant parameter of each frame; and a synthesis section configured to generate a synthesized speech by concatenating the fused speech unit of each segment.

16. A non-transitory computer readable medium storing a program for causing a computer to perform steps comprising:

dividing a phoneme sequence corresponding to a target speech into a plurality of segments;

selecting a plurality of speech units for each segment from a speech unit memory storing speech units having at least one frame, the plurality of speech units having a prosodic feature accordant or similar to the target speech;

generating a formant parameter having at least one formant frequency for each frame of the plurality of speech units;

corresponding formant frequencies of the formant parameters among corresponding frames of the plurality of speech units;

generating a fused formant parameter of each frame from corresponded formant frequencies of formant parameters of each frame of the plurality of speech units;

generating a fused speech unit of each segment from the fused formant parameter of each frame; and generating a sixth program code to generate a synthesized speech by concatenating the fused speech unit of each segment.

* * * * *